US008425985B2

(12) United States Patent
Buck et al.

(10) Patent No.: US 8,425,985 B2
(45) Date of Patent: Apr. 23, 2013

(54) METHOD FOR PARTICULATE COATING

(75) Inventors: Thomas L. Buck, Corning, NY (US); Jia Liu, Painted Post, NY (US); Natesan Venkataraman, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 447 days.

(21) Appl. No.: 12/486,807

(22) Filed: Jun. 18, 2009

(65) Prior Publication Data

US 2010/0047466 A1 Feb. 25, 2010

Related U.S. Application Data

(60) Provisional application No. 61/091,015, filed on Aug. 22, 2008.

(51) Int. Cl.
*B05D 1/18* (2006.01)

(52) U.S. Cl.
USPC ..... 427/430.1; 427/180

(58) Field of Classification Search ..... 427/430.1, 427/299, 180
See application file for complete search history.

(56) References Cited

U.S. PATENT DOCUMENTS

| | | | | |
|---|---|---|---|---|
| 2,633,426 | A * | 3/1953 | Koller | 427/64 |
| 4,511,604 | A * | 4/1985 | Barraud et al. | 427/402 |
| 4,977,242 | A | 12/1990 | Kumaki | 528/499 |
| 5,651,921 | A * | 7/1997 | Kaijou | 516/34 |
| 7,022,303 | B2 | 4/2006 | Riman et al. | 423/594.9 |
| 2005/0188916 | A1 | 9/2005 | Riman et al. | 117/21 |
| 2010/0307552 | A1 * | 12/2010 | Kohnke et al. | 136/243 |

FOREIGN PATENT DOCUMENTS

| | | |
|---|---|---|
| EP | 0 270 212 | 6/1988 |
| EP | 0 595 606 | 5/1994 |
| EP | 0 728 531 A1 | 8/1996 |
| WO | WO2005015792 A3 | 2/2005 |
| WO | 2009/120344 | 10/2009 |

OTHER PUBLICATIONS

Shishido et al. Preparation of ordered mono-particulate film from colloidal solutions on the surface of water and continous transcripotion of film to subtrate. Colloids and Surfaces A: Physicochem. Eng. Aspects 211 (Aug. 25, 2007) 32-41.*

Shishido, M.; Kitagawa, D, Preparation of Ordered Mono-Particulate Film From Colloidal Solutions on the Surface of Water and Continuous Transcription of Film to Substrate, *Science Direct, Collards and Surfaces: Physiochem, Eng. Aspects* 311 (2007) pp. 32-41.

Joannoupolous, J. D.; Meade, R. D.; Winn, J. N., *Photonic Crystals.* Princeton University Press: New Jersey, 1995, pp. 3-7.

Asher, S. A.; Holtz, J.; Weissman, J.; Pan, G., Mesoscopically periodic photonic-crystal materials for linear and nonlinear optics and chemical sensing. *MRS Bulletin* 1998, 23, (10), pp. 44-50.

(Continued)

*Primary Examiner* — David Turocy
(74) *Attorney, Agent, or Firm* — John L. Haack

(57) ABSTRACT

A coating method including forming a coating liquid having modified particles, the modified particles being formed by covalently attaching at least one modifier to at least one particle; forming a coating layer on a surface of subphase liquid in a container; and separating a substrate and the container.

13 Claims, 7 Drawing Sheets

OTHER PUBLICATIONS

Van Blaaderen, A., From the de broglie to visible wavelengths: Manipulating electrons and photons with colloids. *MRS Bulletin* 1998, 23, (10), pp. 39-43.
Colvin, V. L., From opals to optics: Colloidal photonic crystals. *MRS Bulletin* 2001, 26, (8), pp. 637-641.
Gates, B.; Lu, Y.; Li, Z. Y.; Xia, Y., Fabrication and characterization of photonic crystals with well-controlled thickness and stop-band attenuation. *Applied Physics A: Materials Science and Processing* 2003, 76, (4), pp. 509-513.
Painter, O.; Lee, R. K.; Scherer, A.; Yariv, A.; O'Brien, J. D.; Dapkus, P. D.; Kim, I., Two-Dimensional Photonic Band-Gap Defect Mode Laser. *Science* 1999, 284, pp. 1819-1821.
Wang, Y.; Anderson, C., Formation of thin transparent conductive composite films from aqueous colloidal dispersions. *Macromolecules* 1999, 32, (19), pp. 6172-6179.
Matsushita, S. I.; Yagi, Y.; Miwa, T.; Tryk, D. A.; Koda, T.; Fujishima, A., Light propagation in composite two-dimensional arrays of polystyrene spherical particles. *Langmuir* 2000, 16, (2), pp. 636-642.
Bravo, J.; Zhai, L.; Wu, Z.; Cohen, R. E.; Rubner, M. F., Transparent superhydrophobic films based on silica nanoparticles. *Langmuir* 2007, 23, (13), pp. 7293-7298.
Cebeci, F. C.; Wu, Z.; Zhai, L.; Cohen, R. E.; Rubner, M. F., Nanoporosity-Driven Superhydrophilicity: A Means to Create Multifunctional Antifogging Coatings. *Langmuir* 2006, 22, pp. 2856-2862.
Wei, A., Designing Plasmonic Nanomaterials as Sensors of Biochemical Transport. *J. Surf. Sci. Nanotech.* 2006, 4, pp. 9-18.
Rizza, R.; Fitzmaurice, D.; Hearne, S.; Hughes, G.; Spoto, G.; Ciliberto, E.; Harald, K.; Schropp, R., Self-Assembly of Monolayers of Semiconductor Nanocrystallites. *Chem. Mater.* 1997, 9, pp. 2969-2982.
Giersig, M.; Mulvaney, P., Formation of ordered two-dimensional gold colloid lattices by electrophoretic deposition. *Journal of Physical Chemistry* 1993, 97, (24), pp. 6334-6336.
Bigioni, T. P.; Lin, X.-M.; Nguyen, T. T.; Corwin, E. I.; Witten, T. A.; Jaeger, H. M., Kinetically driven self assembly of highly ordered nanoparticle monolayers. *Nature Materials* 2006, 5, p. 265.
Yang, S. M.; Miguez, H.; Ozin, G. A., Opal Circuits of Light—Planarized Microphotonic Crystal Chips. *Advanced Functional Materials* 2002, 12, (6-7), pp. 425-431.
Prevo, B. G.; Velev, O. D., Controlled, Rapid Deposition of Structured Coatings from Micro- and Nanoparticle Suspensions. *Langmuir* 2004, 20, pp. 2099-2107.
Burmeister, F.; Schafle, C.; Keilhofer, B.; Bechinger, C.; Boneberg, J.; Leiderer, P., From mesoscopic to nanoscopic surface structures: Lithography with colloid monolayers. *Advanced Materials* 1998, 10, (6), pp. 495-497.
Hulteen, J. C.; Van Duyne, R. P., Nanosphere lithography: A materials general fabrication process for periodic particle array surfaces. *Journal of Vacuum Science & Technology A* 1995, 13, pp. 1553-1558.
Wang, W.; Gu, B.; Liang, L.; Hamilton, W., Fabrication of Two- and Three-Dimensional Silica Nanocolloidal Particle Arrays. *Journal of Physical Chemistry B* 2003, 107, pp. 3400-3404.
Gates, B.; Qin, D.; Xia, Y., Assembly of Nanoparticles into Opaline Structures over Large Areas. *Adv. Mater.* 1999, 11, p. 466.
Ulman, A., *An Introduction to Ultrathin Organic Films: From Langmuir-Blodgett to Self-Assembly.* Academic Press: 1991, pp. 101-128.
Liu, J.; Lee, T.; Janes, D. B.; Walsh, B. L.; Melloch, M. R.; Woodall, J. M.; Reifenberger, R.; Andres, R. P., Guided self-assembly of Au nanocluster arrays electronically coupled to semiconductor device layers. *Applied Physics Letters* 2000, 77, (3), pp. 373-375.
Lin, Y.; Skaff, H.; Emrick, T.; Dinsmore, A. D.; Russell, T. P., Nanoparticle Assembly and Transport at Liquid-Liquid Interfaces. *Science* 2003, 299, pp. 226-229.
Liu, X.; McCandlish, E. F.; McCandlish, L. E.; Mikulka-Bolen, K.; Ramesh, R.; Cosandey, F.; Rossetti, G. A., Jr.; Riman, R. E., Single-Crystal-like Materials by the Self-Assembly of Cube-Shaped Lead Zirconate Titanate (PZT) Microcrystals. *Langmuir* 2005, 21, pp. 3207-3212.

* cited by examiner

METHOD FOR PARTICULATE COATING

This application claims the benefit of U.S. Provisional Application Ser. No. 61/091,015, filed on Aug. 22, 2008. The content of this document and the entire disclosure of any publication, patent, or patent document mentioned herein is incorporated by reference.

FIELD

The disclosure relates to a method for particulate coating on a substrate.

BACKGROUND

Thin films of both micro- and nano-particles are of technological interest. Such films can provide new and different properties to articles coated therewith, including chemical, optical and electronic properties, as well as various surface properties. Examples of articles that include coatings to provide desired properties include photonic crystals; lasers formed of two-dimensional assemblies of colloidal particles; films for altering surface properties such as conductivity on composite substrates for sensor applications; waveguides; coatings for modifying wetting properties; and surface enhanced raman spectroscopy (SERS) substrates.

Methods of forming micro- and nano-particle coatings are many and varied. Most of the methods however have limited practical applications because of small sample sizes, slow coating rates, difficulty in controlling the coating thickness, the need for complex equipment, or a combination of these problems. A recent advance in coating techniques includes a method of forming a monolayer of particles on a supporting fluid. This method solves some of the above mentioned problems but other problems remain.

SUMMARY

A coating method including forming a coating liquid, the coating liquid having surface modified particles; forming a coating layer on a surface of a subphase liquid in a container; and separating the substrate from the container.

A particulate coating method including forming a coating liquid, the coating liquid includes at least one modified particle and liquid carrier, the at least one modified particle can be formed by covalently attaching at least one modifier to at least one particle; forming a coating layer of the coating liquid on a surface of a subphase liquid, the subphase liquid being contained in a container, a substrate being at least partially immersed within the subphase liquid, the coating liquid having a substantially unitary direction of flow in the container; and separating the substrate from the container to transfer at least a portion of the coating layer to the substrate forming a particulate coating.

A particulate coating method that includes forming a coating liquid, the coating liquid includes at least one hydrophobically modified particle and liquid carrier, the at least one hydrophobically modified particle being formed by covalently attaching at least one hydrophobic modifier to at least one particle; streaming the coating liquid into a container, the container contains a subphase liquid having a substrate at least partially immersed therein, the coating liquid having a substantially unitary direction of flow in the container; and separating the substrate and the container to form a particulate coating on the substrate.

DESCRIPTION OF THE DRAWINGS

The disclosure may be more completely understood in consideration of the following detailed description of various embodiments of the disclosure in connection with the accompanying drawings, in which.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1A:
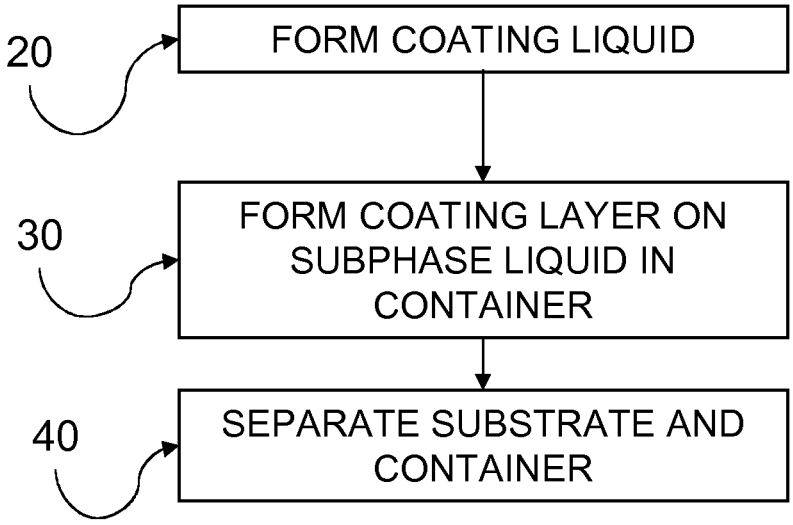
FIG. 1*a* is a flow chart illustrating an exemplary particulate coating method.

In the following description, reference is made to the accompanying set of drawings that form a part hereof and in which are shown by way of illustration several specific embodiments. It is to be understood that other embodiments are contemplated and may be made without departing from the scope or spirit of the present disclosure. The following detailed description, therefore, is not to be taken in a limiting sense. The definitions provided herein are to facilitate understanding of certain terms used frequently herein and do not limit the scope of the present disclosure.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

The recitation of numerical ranges by endpoints includes all numbers subsumed within that range (e.g., 1 to 5 includes 1, 1.5, 2, 2.75, 3, 3.80, 4, and 5) and any range within that range.

As used in this specification and the appended claims, the singular forms "a", "an", and "the" encompass embodiments having plural referents, unless the content clearly dictates otherwise. As used in this specification, use of a singular form of a term, can encompass embodiments including more than one of such term, unless the content clearly dictates otherwise. For example, the phrase "modifying a particle" encompasses modifying one particle, or more than one particle, unless the content clearly dictates otherwise. As used in this specification and the appended claims, the term "or" is generally employed in its sense including "and/or" unless the context clearly dictates otherwise.

As used in this specification, hydrophobic generally has the meaning given it by those of skill in the art. Specifically, hydrophobic means antagonistic to water, mostly incapable of dissolving in water in any appreciable amount or being repelled from water. Hydrophobic molecules tend to be nonpolar and thus prefer other neutral molecules and nonpolar solvents. Exemplary hydrophobic molecules include, but are not limited to, alkanes, oils, fats, and greasy substances in general.

As used in this specification, hydrophilic generally has the meaning given it by those of skill in the art. Specifically, hydrophilic means having a strong tendency to bind or absorb water, or the ability to transiently bind to water or be easily dissolved in water or other polar solvents. A hydrophilic molecule is one that is typically charge-polarized and capable of hydrogen bonding. Hydrophilic molecules tend to be polar molecules. Exemplary hydrophilic molecules include, but are not limited to, acids and bases or molecules having acidic portions or basic portions.

Figure 1B:
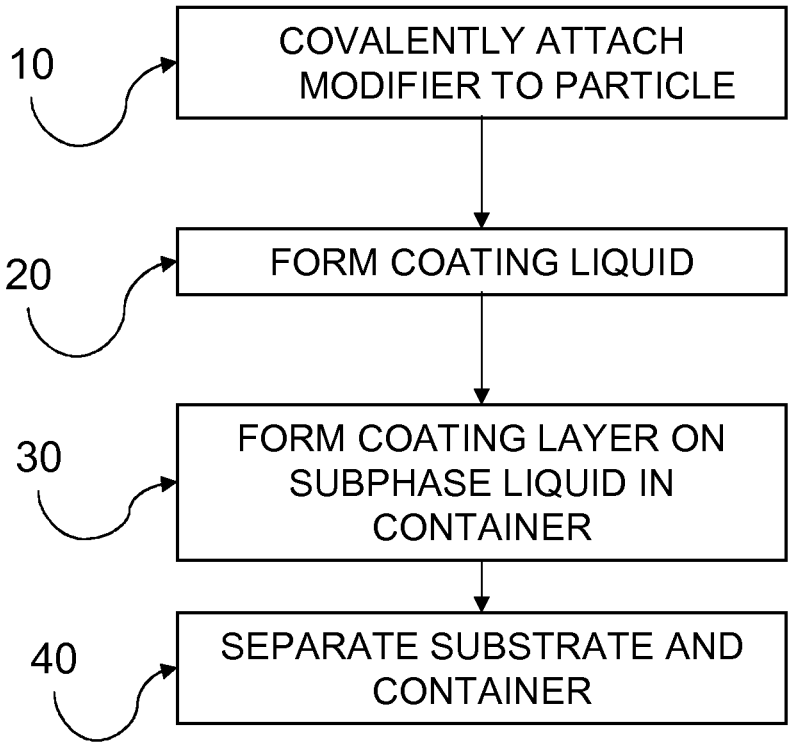
FIG. 1*b* is a flow chart illustrating an exemplary particulate coating method.

The present disclosure relates to particulate coating methods. Embodiments of particulate coating methods are schematically depicted in FIGS. 1*a* and 1*b*. As seen in FIG. 1*a*, a coating method can include step 20, preparing a coating liquid; followed by step 30, forming a coating layer on a surface of subphase liquid in a container; and step 40, separating a substrate and the container. Another exemplary coating method is depicted in FIG. 1*b* and includes step 10, covalently attaching at least one modifier to at least one particle; followed by step 20, forming a coating liquid; followed by step 30, forming a coating layer on a surface of subphase liquid in a container; and step 40, separating a substrate and the container.

An exemplary embodiment of a method as disclosed herein can include a step 10 of covalently attaching at least one modifier to at least one particle. Some embodiments of methods disclosed herein do not include step 10. The step of covalently attaching a modifier to a particle generally forms a modified particle. Step 10 generally functions to affect the surface properties of a particle. As an example, covalently attaching a hydrophobic modifier to a hydrophilic particle can tend to provide a modified particle with surface properties that are more hydrophobic than the unmodified particle was. Modifiers can be covalently attached to particles that have the same properties as the modifiers, similar properties as the modifiers, slightly different properties as the modifiers, entirely different properties as the modifiers, or some variation thereof. In an embodiment, a modifier is covalently attached to a particle that has different properties than the modifier in order to alter the surface properties of the particle.

Covalently attaching a modifier to a particle generally chemically bonds the modifier to the particle. Covalent attachment can also be referred to as a chemical graft. Generally, any methods of covalently attaching the modifier to the particle that are commonly used by one of skill in the art can be utilized herein. The particular method that will be used to chemically graft any particular modifier to any particular particle will depend on the identity and more specifically the chemical structure of both the modifier and the particle. The particular method of covalent attachment that is utilized can also have an effect on the final properties of the modified particles. Covalently attaching the modifiers to the particle ensures that the particle will maintain the properties of the modifier for at least as long as is practically required to carry out the method.

The layer of modifiers on the particles generally produces a layer that is relatively thin. In an embodiment, the layer of modifiers on the surface of the particles has a thickness that measures in nanometers or less. The relatively thin layer of modifier on the particle can offer an advantage because any undesired properties of the modifier will be minimized because of the relatively insignificant amount of the modifier present on the particles. Other methods that utilize different ways of modifying the surface properties of the particles can have a detrimental effect because of the relatively larger amount of the modifying material. Such methods often must go through extra steps to remove the relatively large amounts of modifying material, which can cause additional processing steps and can even in some cases damage the article.

Particles that can be used in methods as disclosed herein are generally not limited. Particles that can be used in methods as disclosed herein can have properties that are generally described as hydrophilic, properties that are generally described as hydrophobic, properties that are generally described as amphiphilic, or are generally described as not significantly having such properties. Generally, the particle can be chosen based on the particular application of the final coated layer, or the final coated article. Exemplary types of particles that can be utilized include, but are not limited to, glass particles, inorganic non-metallic particles, metallic particles, polymer particles, semiconductive particles, or combinations thereof. Exemplary types of non-metallic particles include, but are not limited to, inorganic nitride particles, inorganic halide particles, and inorganic oxide particles. Exemplary types of inorganic oxide particles include, but are not limited to, silica ($SiO_2$), tin oxide, zinc oxide, indium tin oxide (ITO), tungsten oxide, zirconium oxide, and borosilicate particles. Exemplary types of metallic particles include, but are not limited to noble metal particles. Exemplary types of noble metal particles that can be coated using this method include, but are not limited to gold (Au), silver (Ag), palladium (Pd), platinum (Pt), or combinations thereof.

Generally, any size particles that are generally used by those of skill in the art can be utilized herein. As particles become larger, heavier, or both the ability of the particles to be maintained on the surface of the subphase liquid decreases. This can cause the particles to fall out of suspension and therefore not be able to be coated onto a substrate. This can be compensated for, partially or fully, by increasing the surface tension of the subphase liquid. Generally, there is no lower limit for the size of particles that can be coated. In an embodiment, particles having diameters from about 2 nanometers (nm) to about 20 micrometers (μm) can be coated using methods disclosed herein. In an embodiment, particles having diameters from about 4 nm to about 5 μm can be coated using methods disclosed herein. In an embodiment, particles having diameters from about 20 nm to about 4.8 μm can be coated using methods disclosed herein. In an embodiment, particles having diameters from about 40 nm to about 4 μm can be coated using methods disclosed herein.

Generally, particles have a distribution of particle sizes, such as particle diameter. Generally, particles having any size distribution can be utilized. The diameter dispersion of particles is the range of diameters of the particles. Particles can have monodisperse diameters, polydisperse diameters, or a combination thereof. Particles that have a monodisperse diameter have substantially the same diameter. Particles that have polydisperse diameters have a range of diameters distributed in a continuous manner about an average diameter. Generally, an average size of polydisperse particles is reported as the particle size. Such particles will have diameters that fall within a range of values.

In an embodiment, one or more monodisperse particles can also be utilized. In an embodiment, particles having two different monodisperse diameters can be utilized. In an embodiment, monodisperse particles that are large can be utilized in combination with monodisperse particles that are small. Such an embodiment can be advantageous because the "small" particles can fill voids between the "large" particles and thereby provide very good packing. An example of two different monodisperse particle sizes that could be utilized include, monodisperse particles having a diameter of 4.9 μm and monodisperse particles having a diameter of 0.7 μm.

Generally, the density of a particle is dictated, at least in part, by the identity of the particle itself. A particle can generally have a size and density that allows the modified particle to be supported by the subphase liquid. In an embodiment, the subphase liquid can be modified to support heavier particles. An example of such a modification would be the use of heavy water ($D_2O$), an aqueous salt solution, or a combination thereof as a subphase liquid (instead of $H_2O$).

Generally, any shape particle can be utilized herein. The particular shape of the particle to be used can depend at least in part, on the final application of the coating or the coated article. Exemplary particle shapes include, but are not limited to spherically shaped, semi-spherically shaped, spheroidally shaped, cube shaped, rod shaped, and irregularly shaped for example. Hollow particles and particles having a core/shell structure can also be utilized herein.

Modifiers that can be utilized in methods as disclosed herein are generally not limited. The particular modifier that can be chosen can depend, at least in part, on the desired application for the coating or the coated article, the particular particle that the modifier is being covalently attached to, the property that is desired to be imparted to the particle, the carrier liquid being utilized, and the subphase liquid that is being utilized in the coating method. More than one kind of modifier can be covalently attached to one (or more than one) kind of particle in a single coating method. Modifiers can be hydrophobic, hydrophilic, or ampiphillic for example. In an embodiment, the modifiers are hydrophobic.

In an embodiment where the modifier is hydrophobic, a number of different factors can be considered and utilized to obtain different levels of hydrophobicity. Factors that can be considered to determine the level of hydrophobicity include, but are not limited to the amount of modifier on the surface of the particles, the type of modifier that is being utilized, the way in which the modifier is covalently attached to the particle, as well as others. Generally, less of a hydrophobic modifier on the surface of a particle will render the particle less hydrophobic.

In an embodiment, the modifier can be a silane molecule. In an embodiment, the modifier can be an organosilane molecule. In an embodiment, silane molecules or more specifically organosilane molecules can be utilized as modifiers in methods where the particle is an inorganic oxide particle. Exemplary silane molecules that can be utilized include, but are not limited to silanes that are not very reactive. For example, it is thought that trichlorosilane is more reactive than trimethyoxysilane or triethoxysilane.

In an embodiment, silanes having substituents having long chain alkyl groups can be utilized. In an embodiment, silanes where all substituents have long chain alkyl groups can be utilized. In an embodiment, silanes having substituents having $C_8$ alkyl or larger alkyl groups can be utilized. In an embodiment, silanes having substituents having $C_{12}$ alkyl or larger alkyl groups can be utilized. In an embodiment, silanes having substituents having $C_{16}$ alkyl or larger alkyl groups can be utilized. In an embodiment, silanes having substituents having a $C_8$ to $C_{24}$ alkyl group can be utilized. Exemplary silane molecules that can be utilized include, but are not limited to, octadecyltrimethoxysilane (OTMS), and octadecyltriethoxysilane (OTES).

In an embodiment, the modifier can be a carboxylic acid containing molecule. Carboxylic acid containing molecules can be utilized as modifiers in methods where the particle is an inorganic oxide particle. In an embodiment, the modifier can be a thiol molecule. In an embodiment, the modifier can be an alkanethiol molecule. In an embodiment, thiol molecules or more specifically alkanethiol molecules can be utilized as modifiers in methods where the particle is a noble metal particle.

Reagents, conditions and amounts of reagents necessary for covalently attaching a particular modifier to a particular particle would depend, at least in part, on the identities of both components. Generally, the amount of modifier that is to be covalently attached to the particle will depend at least in part on the size of the particle, the amount of particles being attached to, and the way in which the modifier is covalently attached. Reagents, conditions and amounts would be apparent to one of skill in the art, having read this specification.

In an embodiment depicted in FIG. 1*a*, the first step in a method as disclosed herein includes step 20, forming a coating liquid. As noted above, the step of forming a coating liquid need not be preceded by the step of covalently attaching at least one modifier to a particle to form a modified particle (as is depicted in FIG. 1*b*); instead the first step may include preparing a coating liquid having at least one modified particle and liquid carrier.

The step of forming a coating liquid functions to disperse the modified particle (made by covalently attaching a modifier to a particle) in a liquid carrier. The coating liquid that is formed during this step can be generally at least mostly homogeneous or can be made to be at least mostly homogeneous. In an embodiment, the coating liquid can be substantially entirely homogeneous. In an embodiment, the coating liquid can be a dispersion. The function of the coating liquid in the broader method is to allow the modified particles to be spread across the surface of the subphase liquid.

The coating liquid can be formed as would be apparent to one of skill in the art, having read this specification. Generally, the coating liquid can be formed by first preparing or obtaining the modified particles and then dispersing the modified particles in a suitable liquid carrier. Dispersion of the modified particles in the liquid carrier can be accomplished by those of skill in the art, including but not limited to sonication, stirring, shaking, or similar methods. The coating liquid, once formed can, but need not be, stable over an extended period of time. Stable in the context of the coating liquid implies that the particles do not aggregate over time, and if the particles do aggregate, they can easily be unaggregated. In a stable coating liquid, the particles may settle, under the force of gravity, but can easily be redispsersed using known methods such as sonication, shaking, or both.

The coating liquid includes modified particles and liquid carrier. The liquid carrier functions to disperse the modified particles in the coating liquid. The liquid carrier is generally chosen to have properties such that it has a relatively large spreading tension on the subphase liquid. Properties that may be relevant to the ability of the liquid carrier to spread on the subphase liquid include, but are not limited to, the surface tension of the liquid carrier, the surface tension of the subphase liquid and the viscosity of the liquid carrier.

The liquid carrier can generally be chosen with properties such that it will not accumulate on the subphase. Properties that may be relevant to the ability of the liquid carrier to not accumulate on the subphase liquid include, but are not limited to, the miscibility of the liquid carrier with the subphase, and the vapor pressure of the liquid carrier. In an embodiment, the liquid carrier can be chosen to be miscible or at least partially miscible in the subphase. In an embodiment, the liquid carrier can be chosen to have a relatively high vapor pressure. The liquid carrier can also be chosen as one that can easily be recovered from the subphase. The liquid carrier can also be chosen as one that is not considered environmentally or occupationally hazardous or undesirable. In an embodiment, the liquid carrier can be chosen based on one of, more than one of, or even all of the above noted properties. In some instances, properties other than those discussed herein may also be relevant to the choice of liquid carrier.

In an embodiment, the liquid carrier can be, for example, a single solvent, a mixture of solvents, or a solvent (a single solvent or a mixture of solvents) having other non-solvent components. Exemplary solvents that can be utilized include, but are not limited to, a hydrocarbon, a halogenated hydrocarbon, an alcohol, an ether, a ketone, and like substances, or mixtures thereof, such as 2-propanol (also referred to as isopropanol, IPA, or isopropyl alcohol), tetrahydrofuran (THF), ethanol, chloroform, acetone, butanol, octanol, pentane, hexane, cyclohexane, and mixtures thereof. In an embodiment where the subphase is a polar liquid (such as water), exemplary liquid carriers that can be utilized include, but are not limited to, 2-propanol, tetrahydrofuan, and ethanol for example. Non-solvent components that can be added to a solvent to form the liquid carrier include, but are not limited to, dispersants, salts, and viscosity modifiers.

Generally, the concentration of the modified particles in the coating liquid can depend at least in part on the particles (both identity and size), the modifier, the thickness of the coating to be formed, the liquid carrier, the subphase liquid, a desired rate at which the substrate can be separated from the container to coat, and the size of the substrate. Generally, there is no upper or lower limit on the concentration of the modified particles in the coating liquid. In an embodiment, the modified particles can have a concentration of about 0.05 mg/mL to about 20 mg/mL in the coating liquid, depending on the particle size. In an embodiment, the modified particles can have a concentration of about 0.06 mg/mL to about 16 mg/mL in the coating liquid, depending on the particle size. In an embodiment, where the particle size has an average diameter of about 2.5 μm, the modified particles can have a concentration of about 8 mg/mL in the coating liquid.

The next step in a method as described herein is depicted in FIGS. 1*a* and 1*b* as step 30, forming a coating layer on the subphase liquid. The step of forming a coating layer of the coating liquid functions to spread the modified particles across the surface of the subphase liquid so that the substrate can be somewhat evenly coated. The step of forming a coating layer could also be said to function to form a monolayer of the modified particles on the surface of the subphase liquid.

Figure 2A:
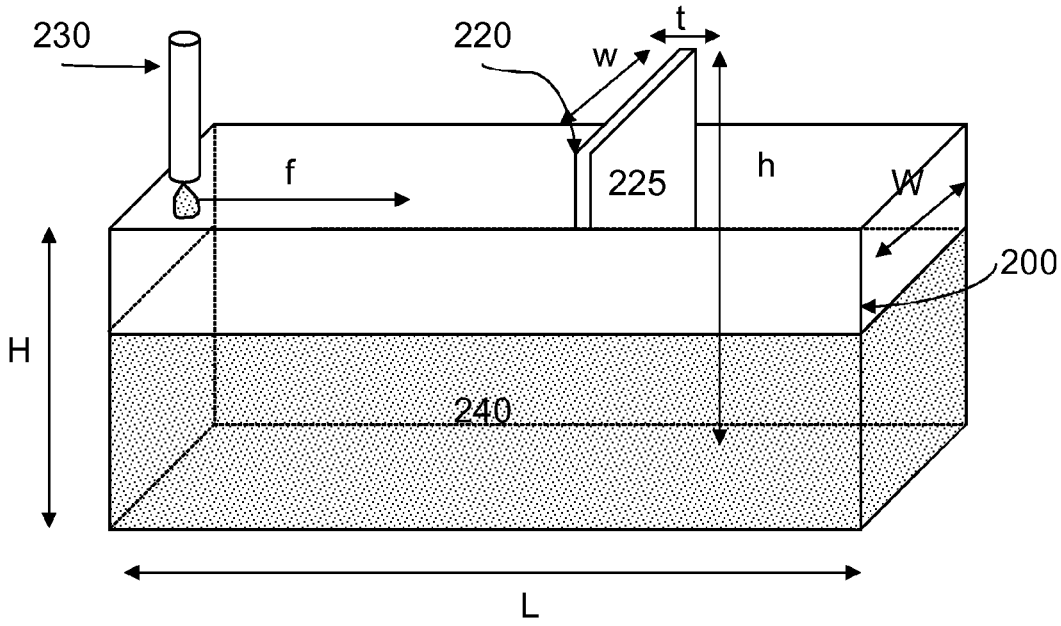
FIG. 2*a* is a schematic illustration of an exemplary configuration for carrying out a method showing a normal orientation of a single substrate.

The subphase liquid is contained in a coating container. An exemplary coating container 200 is depicted in FIG. 2*a*. Generally, a coating container is a container that is or can be configured to allow the subphase liquid to be added and contained, the substrate to be coated to be at least partially immersed, and the coating liquid to be dispensed into it. The coating container 200 exemplified in FIG. 2*a* is shown as being rectangular, however, there is no limitation on the shape of coating containers that may be used. Generally, the size and shape of a coating container that may be utilized can depend, at least in part, on the size, shape, and number of substrates that are desired to be coated at any one time. Factors other than those discussed herein can also play a role in the desired size and shape of a coating container that may be utilized in methods as disclosed herein.

Generally, the larger the substrate that is to be coated, the larger the coating container can be; and conversely, the smaller the substrate that is to be coated, the smaller the coating container can be. In an embodiment where multiple substrates are coated simultaneously, the coating container can allow the multiple substrates to be at least partially immersed simultaneously. In an embodiment where multiple substrates are being coated simultaneously, a coating container that affords space between substrates can be utilized.

The size of the coating container 200 depicted in FIG. 2*a* can be described by its dimensions; the length, L, the height, H and the width, W. Coating containers that are other than rectangular can be described by other dimensions. In an embodiment, a coating container that is rectangular can have dimensions that depend on the substrate or substrates to be coated. An exemplary coating container can have a rectangular shape and can generally have dimensions that can be measured in inches; a specific non-limiting exemplary embodiment can have a length of about 3 inches, a width of about 1 inch, and a height of about 6 inches. Such an exemplary coating container would be able to carry out a coating method as described herein and coat a substrate having dimensions of about 3 inches long (the h dimension in FIG. 2*a*), 25 mm wide (the w dimension in FIG. 2*a*), and 0.7 mm thick (the t dimension in FIG. 2*a*), as well as substrates with other dimensions.

The coating container contains the subphase liquid. Reference numeral 240 in FIG. 2*a* depicts the subphase liquid. The purpose of the subphase liquid is to provide a surface on which the modified particles can form a monolayer that can then be transferred to the substrate. The subphase liquid is generally contained by the coating container, but need not fill the coating container. The extent to which the subphase liquid fills the coating container can depend, at least in part, on the size of the substrate, the size of the coating container, the desired amount of the substrate to be coated, or a combination thereof. Factors other than these can also be considered to determine the extent to which the subphase liquid should fill the coating container. The subphase liquid can generally be dispensed into the coating container at any time before the coating liquid is dispensed into the coating container.

The subphase liquid is generally chosen in light of the liquid carrier, the identity and size of the modified particle, the substrate to be coated, or a combination thereof. In an embodiment, the subphase liquid can be chosen so that the coating liquid containing the modified particles and the liquid carrier, once dispensed into the coating container will form a layer of modified particles on the surface of the subphase liquid. One property of the subphase liquid that can at least partially determine whether or not the subphase liquid and the coating liquid can form a layer of particles on the surface of the subphase liquid is the nature of the subphase liquid (e.g. polar or non-polar) in comparison to the nature of the liquid carrier. For example, a subphase liquid that is polar (like water) can be used with modified particles that are hydrophobic because the modified particles would, given the thermodynamics of the coating liquid and the subphase liquid, remain on the surface of the polar subphase rather than enter the bulk of the subphase.

Another property of the subphase liquid that can at least partially determine whether or not the subphase liquid and the coating liquid can form a layer of modified particles on the surface of the subphase liquid is the surface tension of the subphase liquid in comparison to the surface tension of the liquid carrier. The ability of the liquid carrier to spread the modified particles on the surface of the subphase liquid is related to the difference in surface tension between the subphase liquid and the liquid carrier. For example, a subphase liquid that has a surface tension that is higher than the surface tension of the liquid carrier would tend to allow the liquid carrier to spread on it spontaneously, thereby spreading the particles on the surface of the subphase liquid. To a lesser extent, the force of gravity which drives the particles to fall through the air/liquid interface also plays a role and is also counteracted by the higher surface tension of the subphase liquid.

Other factors that can dictate, at least in part, the identity of the subphase liquid include the following. In an embodiment the liquid carrier can be miscible or partially miscible in the subphase liquid. In an embodiment, the subphase liquid can also be chosen as one that allows the liquid carrier to be easily recovered from the subphase liquid. The subphase liquid can also be chosen as one that is not considered environmentally or occupationally hazardous or undesirable. In an embodiment, the subphase liquid can be chosen based on one, more than one of, or even all of the factors noted herein. In some instances, factors other than those discussed herein may also be relevant to the choice of subphase liquid.

The subphase liquid may include a single solvent, or more than one solvent. The subphase liquid may also include or consist entirely of non-solvent components. Exemplary liquids that may be used as the subphase liquid include, but are not limited to water, or mixtures of water and alcohols, such as a mixture of water and 2-propanol. In an embodiment where the modified particles are hydrophobic in nature, the subphase liquid can be water. In an embodiment, a second solvent can be added to water (or other solvents) to alter certain properties of water in desired ways. Examples of other solvents that can be added to alter certain properties of water include, but are not limited to alcohols, such as 2-propanol, ethanol, THF or mixtures thereof. Such solvents can be utilized to control the spreading tension of the coating liquid on the subphase liquid. In an embodiment, non-solvent components can be added to water (or other solvents) in order to alter certain properties of water in desired ways. Examples of non-solvent components that can be added to water to alter certain properties of water include, but are not limited to, glycerol to alter the viscosity of the water; salts to affect the ionic strength of the subphase; acids, bases, or both acids and bases to affect the pH, ionic strength, or both pH and ionic strength of the subphase.

To form a coating layer on the surface of the subphase liquid, the coating liquid is dispensed into the coating container. The coating liquid can be dispensed into the coating container using methods known to those of skill in the art having read this specification. In an embodiment, the coating liquid is dispensed into the coating container at a single location. FIG. 2*a* depicts such an embodiment, where the dispenser 230 is depicted at one end of the coating container. In such an embodiment, the coating liquid, once dispensed into the coating container via the dispenser 230 will move on the surface of the subphase liquid away from the dispenser 230 in the direction of the flow arrow, f. The flow of the coating liquid is therefore towards the substrate 220.

In an embodiment, the coating liquid has an overall flow in a substantially unitary direction towards the substrate. Generally, the concentration of the coating liquid that is formed at the dispenser 230 generally forces the flow substantially along the direction f shown in FIG. 2*a* towards the substrate 220. Stated another way, the sum total of all vectors of flow of the coating liquid due at least in part to diffusion is substantially in the direction f. This can be contrasted to a situation in which the dispenser could be placed in the middle of a circular container; in such a situation, the sum total of all vectors of flow of the coating liquid due at least in part to diffusion would generally cancel out, as diffusion would force the coating liquid away from the dispenser in all directions equally. Stated yet another way, the overall flow of the coating liquid is substantially parallel to the side walls of the container. As used in this paragraph, the term "substantially" can imply, for example, less than or equal to about 15°; less than or equal to 10°; or less than or equal to about 5° deviation from a parallel flow path or front.

The rate at which the coating liquid is dispensed into the coating container 200 can be dictated at least in part by the type and size of the modified particles, the liquid carrier, the subphase liquid, the concentration of the modified particles in the coating liquid, the dimensions and configuration of the coating container, the size of the substrate(s), the number and configuration of substrates that are being coated, the rate at which the substrate is separated from the coating container, or a combination thereof. Factors other than those discussed above can also be considered to determine the rate at which the coating liquid is dispensed into the coating container. The rate at which the coating liquid is dispensed into the coating container need not be constant over time and can be varied. In an embodiment, where a rectangular coating container having dimensions of inches is utilized, the rate of adding the coating liquid to the coating container can range, for example, from about 0.1 mL/min to about 1 mL/min.

The coating liquid can also be dispensed into the coating container in an amount sufficient to form a layer of the modified particles on the surface of the subphase. In an embodiment, the coating liquid can be dispensed into the coating container in an amount sufficient to form a monolayer of the modified particles on the surface of the subphase. Modified particles that may fall into the subphase liquid, due to the force of gravity, can be replaced by the addition of more coating liquid to the coating container. In an embodiment where more than one substrate is to be coated, the monolayer can be reformed by dispensing more coating liquid into the coating container once the first substrate has been coated.

Alternatively, the coating liquid can be continuously dispensed into the coating container in multiple substrate coating methods. In a continuous method, a film or monolayer of the modified particles is formed, substrates are separated or withdrawn from the container and more coating liquid is added in a substantially continuous and simultaneous fashion. Methods as disclosed herein can offer advantages when carried out in a continuous fashion because of the way in which the coating liquid is dispensed on one end of the coating container and then flows away from that point along a unitary flow direction towards the substrate. The continuous nature is afforded by the separation of the substrate and the coated modified particles thereon from the container, which can then be replenished by the further added coating liquid.

Generally, any method of dispensing the coating liquid into the coating container can be utilized. For example, one or more boluses of the coating liquid can be pulsed into the coating container, or the coating liquid can be dispensed into the coating container in a substantially continuous manner. The coating liquid can also be dispensed into the coating container at different locations in the coating container using multiple dispensers. For example, the coating liquid can be dispensed onto the subphase liquid itself, the coating liquid can be streamed down at a location on one or more sides of the coating container that is not immersed in the subphase liquid, the coating liquid can be streamed into one or more ends of the coating container at or very near the level of the subphase liquid, the coating liquid can also be added to the container below the air/liquid interface of the subphase, or some combination thereof. The coating liquid could also be dispensed into the coating container by streaming the coating liquid down one entire (or substantially entire) edge of the coating container. This could be accomplished for example, by using an overflow device that allows the continuous streaming of the coating liquid from a reservoir onto the edge of the container. In an embodiment, the coating liquid is streamed down one edge of the coating container at one end.

Any device that is generally utilized to dispense liquids over time can be utilized to dispense the coating liquid into the coating container. Exemplary devices include syringe pumps, peristaltic pumps and piston pumps. In an embodiment, a syringe pump can be utilized to dispense the coating liquid into the coating container.

Once the coating liquid is dispensed into the coating container, it generally forms a layer of modified particles on the surface of the subphase liquid. In an embodiment, the layer of modified particles forms a monolayer on the surface of the subphase liquid. At least a portion of the liquid carrier contained within the dispensed coating liquid can dissolve into the subphase liquid, volatilize out of the layer of coating liquid, or a combination thereof. This can take place before, simultaneous with, after, or any combination thereof; the modified particles form a monolayer on the surface of the subphase liquid. In an embodiment, the entire surface of the subphase liquid need not have a monolayer of the modified particles formed thereon. Generally, a monolayer will be more likely to form at a region that is somewhat removed from the region where the coating liquid is dispensed into the coating container.

An embodiment where the coating liquid is dispensed on one end of a container, for example, a rectangular container can offer advantages in either one-time coating methods or continuous coating methods, when compared to dispensing the coating liquid at a different point within the coating container. For example, because the coating liquid is dispensed at one end of the container and flows toward the substrate, less of the coating liquid is allowed to bypass the substrate without being coated. This can lead to less coating liquid being present in the container but not coated on a substrate, or needing to be recovered. From a practical standpoint of large scale coating methods, this can offer advantages.

An embodiment where a rectangular coating container is utilized can offer certain advantages that may not be present, or may not be as easily realized with coating containers of other configurations. Rectangular coating containers can provide an advantage, especially when dispensing the coating liquid on one end, because of the side walls. A rectangular coating container with coating liquid being dispensed at one end can create advantageous forces from the side walls. Upon addition of the coating liquid at one end of the rectangular coating container, a fraction of coating liquid may flow towards the walls on the sides (or ends) of the container not having the source of the coating liquid or the substrate. The presence of side walls may redirect this fraction of coating liquid towards the substrate. The forces associated with this redirection may help with increasing the packing order of the coating on the subphase. In addition, the redirection can allow a unidirectional or unitary flow towards the substrate, allowing for a continuous and efficient coating process. Other container configurations, such as circular (for example); or methods where the coating liquid is dispensed at a point other than at the end (i.e. in the middle of a coating container) would likely not afford these advantages.

Furthermore, a rectangular coating container, where the coating liquid is dispensed at one end and then flows in a unitary direction toward the substrate, may make it easier to switch from one coating liquid to another. Other configurations of coating containers would likely not offer the same ease to switch coating liquids. This could offer practical advantages in larger scale applications.

The coating container depicted in FIG. 2*a* also includes a substrate 220. The substrate 220 is at least partially immersed into the subphase liquid. The substrate contains the surface on which the particulate coating will eventually be formed. The substrate can generally be any type or size of article. As the size, shape, or both, of the substrate change, the coating container can be changed to accommodate the coating thereof. It may also be advantageous to change the amount of the subphase liquid that is in the coating container as the size, shape or both, of the substrate change.

Any type of substrate that are desired to be coated can be utilized herein. In an embodiment, at least the portion of the substrate that is immersed in the subphase liquid is at least partially wetted by the subphase liquid. At least partial wetting of the substrate by the subphase liquid can facilitate (but is not necessary for) the transfer of the modified particles from the surface of the subphase liquid to the substrate. In such an embodiment, a material that accomplishes or enhances the wetting can be the bulk of the substrate or can itself be a coating on the substrate. Exemplary shapes of substrates include, but are not limited to, slabs (thick or thin), cylinders, more complex regular geometries, and irregular shapes. Exemplary materials that can be utilized for substrates include, but are not limited to, glass, plastic, semiconductors, metals, and like materials. Substrates having non-flat geometries can also be coated using methods disclosed herein, examples include, but are not limited to, fibers and tubes. Exemplary sizes of substrates include, but are not limited to substrates having dimensions in the millimeters to substrates having dimensions of feet or larger.

The substrate can be at least partially immersed in the subphase liquid in the coating container. The extent to which the substrate is immersed in the container can dictate, at least in part, how much of the substrate will be coated with modified particles. The substrate can generally be at least partially immersed in the subphase liquid at any time before the coating liquid is dispensed into the coating container; this can take place before, after or simultaneous with the time when the subphase liquid is dispensed into the coating container.

The particular orientation in which the substrate can be partially immersed into the coating container can be dictated, at least in part, by the size and configuration of the coating container, the size and configuration of the substrate to be coated, the extent to which the substrate is desired to be coated, the extent to which the coating container is filled with the subphase liquid, or a combination thereof. Factors other than these can also be considered to determine possible orientations for the substrate within the coating container.

The schematic illustration of FIG. 2*a* shows the portion of the substrate 220 to be coated (the surface opposite back surface 225 that can be seen in FIG. 2*a*) at an orientation that is perpendicular or normal to the flow of the coating liquid, as seen by the arrow f in FIG. 2*a*. This particular embodiment has the short axis (disregarding thickness t), in this case w, of the substrate oriented in the container perpendicular to the direction of the unitary flow of the coating liquid.

Figure 2B:
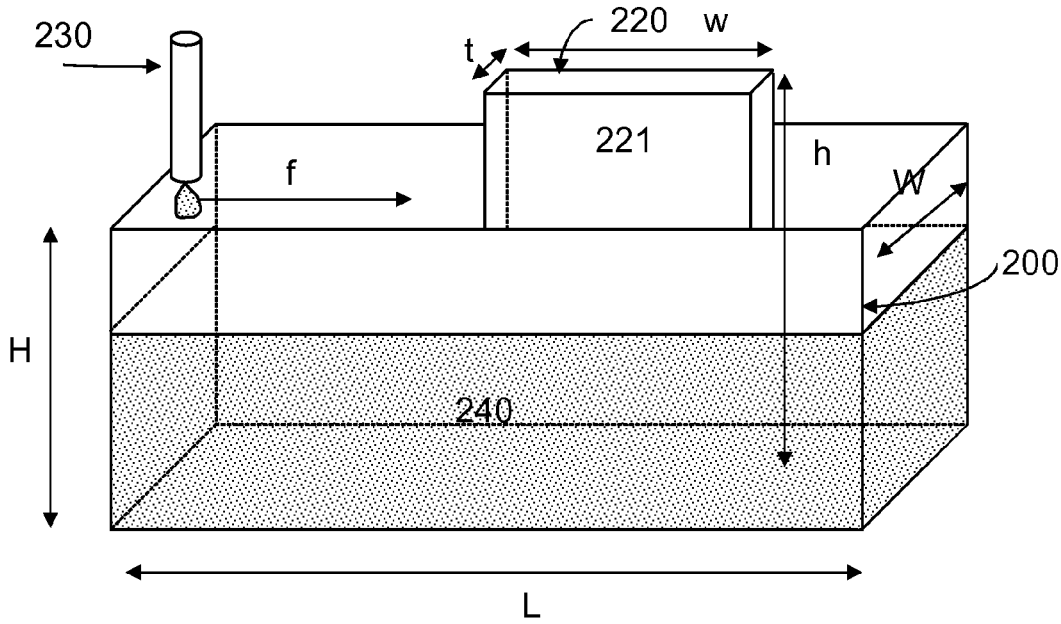
FIG. 2*b* is a schematic illustration of an exemplary configuration for carrying out a method showing a tangential orientation of a single substrate.
Figure 2C:
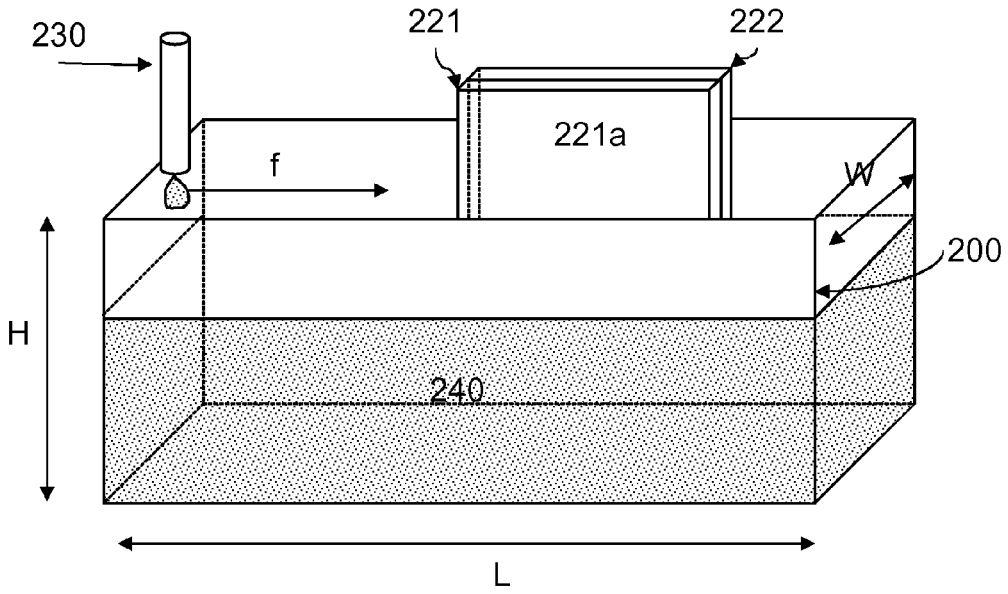
FIG. 2*c* is a schematic illustration of an exemplary configuration for carrying out a method showing a tangential orientation of two substrates.

FIG. 2*b* illustrates another way in which the substrate 220 can be oriented in the coating container. As seen in FIG. 2*b*, the substrate 220 to be coated is oriented tangential or parallel to the flow f of the coating liquid. This particular embodiment has the short axis (disregarding thickness t) in this case w, of the substrate oriented in the container parallel to the direction of the unitary flow of the coating liquid. In this exemplary embodiment, both major surfaces of the substrate (the first surface 221 and the opposing surface, which is not visible because of the perspective of the figure) will be coated when the method is carried out. Tangential or parallel orientation as this is referred to, can offer the advantage of being able to coat multiple shaped substrates in a similarly shaped coating container. For sake of illustration but not limitation, FIG. 2*e* illustrates a spherical or disk shaped substrate 220 being placed in a coating container 200. Substrates having other shapes can also be coated in a rectangular shaped coating container as illustrated therein.

Methods as disclosed herein can also be utilized to coat multiple substrates simultaneously. Methods that coat multiple substrates "simultaneously" refer to the use of one coating container, not that the multiple substrates are necessarily coated at the same time. Although the multiple substrates can be coated at the same time (i.e., separated from the coating container at the same time), "simultaneous coating" does not require simultaneous separation. FIG. 2*c* illustrates an exemplary configuration for a coating method that could be utilized to coat one side only of two substrates simultaneously. The substrates 221 and 222 are placed back to back, with the sides not to be coated facing each other to the inside. The sides to be coated, 221*a* and the back of the second substrate 222 (hidden by the perspective of the figure) are placed in the coating container in contact with the subphase liquid (and eventually the coating layer).

Figure 2D:
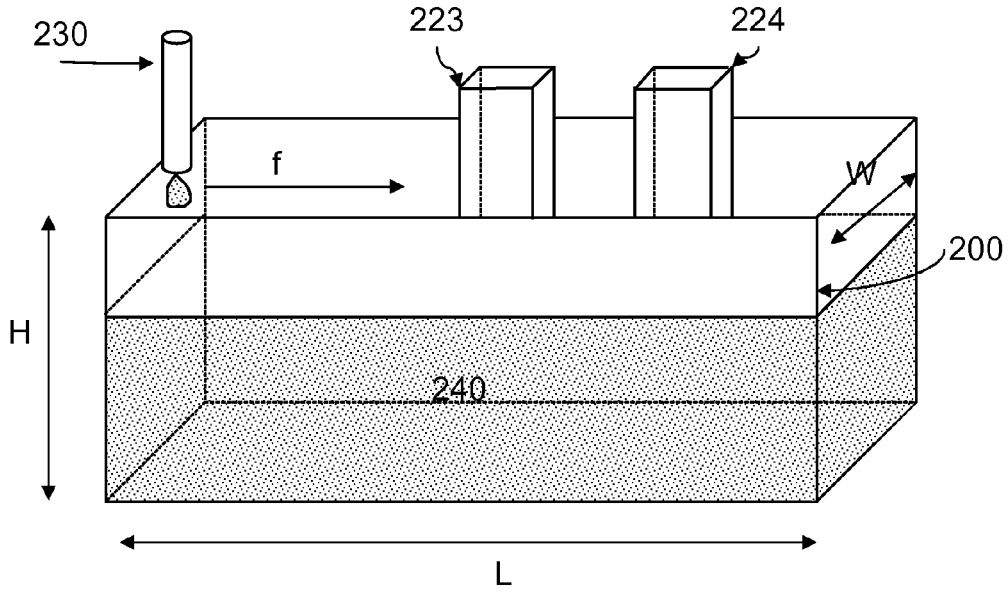
FIG. 2*d* is a schematic illustration of an exemplary configuration for carrying out a method showing a tangential orientation of two substrates.
Figure 2E:
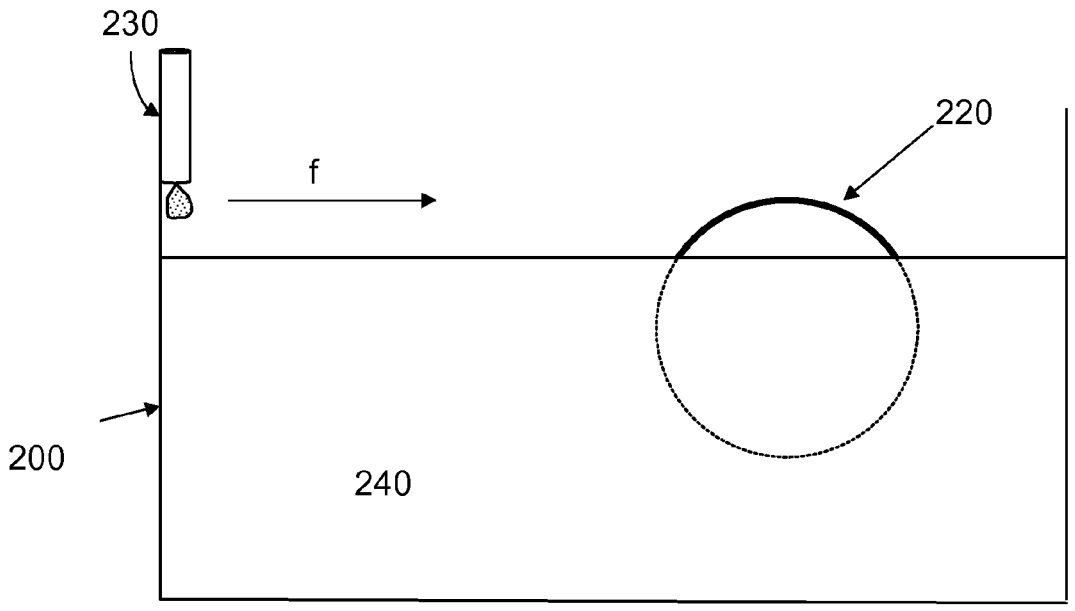
FIG. 2*e* is a schematic illustration of an exemplary configuration for carrying out a method showing a tangential orientation of one spherical substrate.
Figure 2F:
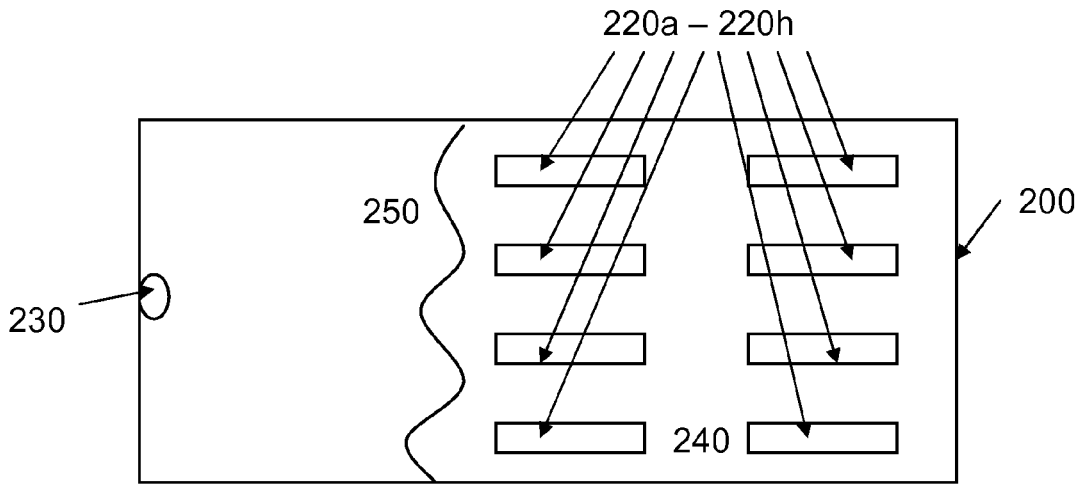
FIG. 2*f* is a schematic illustration of an exemplary configuration for carrying out a method showing a tangential orientation of multiple substrates.

FIG. 2*d* illustrates another exemplary configuration that can be used to coat more than one substrate, placed in the coating container in a tangential orientation, at the same time. As seen in FIG. 2*d*, the two substrates, 223 and 224 are both placed in the coating container simultaneously and can be separated (and thereby coated) from the coating container at the same time or at different times. Generally, multiple substrates can be coated simultaneously by placing them parallel to the direction of coating liquid flow with sufficient spacing from one another. Multiple substrates can also be coated on one side only by having two or more sets of substrates stacked back to back (as seen in FIG. 2*c*) and spaced parallel to the flow of the coating liquid in the coating container. FIG. 2*f* illustrates another exemplary configuration that can be used to coat more than one substrate, placed in the coating container in a tangential orientation, at the same time. As seen in FIG. 2*f* the multiple substrates 220*a*-220*h* are placed in or introduced into the coating container tangential to the flow and spaced apart from each other. This configuration can be used to coat all of the substrates on both sides, simultaneously.

The next step in a method as described herein is depicted in FIGS. 1*a* and 1*b* as step 40, separating the substrate from the coating container. In an embodiment, the substrate and container can be separated by withdrawing the substrate from the coating container, withdrawing the coating container from the substrate, or a combination thereof. In an embodiment, the substrate is withdrawn from the coating container through the coating layer. In an embodiment, the coating container is separated from the substrate so that the surface of the coating layer travels across the substrate as the coating container is separated therefrom.

Generally, this step functions to transfer the coating layer, e.g., the monolayer of modified particles, to the substrate, to form a particulate coating on the substrate. As the substrate is being withdrawn from the coating container (or the reverse), the monolayer of modified particles that exists on the surface of the subphase liquid is continuously transferred onto the substrate. As a result of the particulate monolayer being transferred to the substrate, the remaining monolayer on the subphase liquid moves towards the substrate.

The transfer of the monolayer from the subphase liquid to the substrate can afford significant control of the coating thickness because in embodiments, a single monolayer can be transferred in one coating. Thicker layers can be formed, again controllably, by repeating the forming and separating steps on the same substrate, thereby forming multiple layers of monolayers on the substrate. Multiple layers of more than one component can be formed by utilizing different particles, modifiers, or both for different layers.

Generally, the substrate can be separated from the container, or more specifically the subphase liquid at any angle (measured from the air/liquid interface of the subphase). In an embodiment, the substrate is separated from the subphase liquid at an angle of from about 10° to about 170°. In an embodiment, the substrate is separated from the subphase liquid at an angle of about 90° from the surface of the subphase liquid/coating layer.

The rate at which the substrate can be separated from the coating container (also referred to as a "lift off rate") can be determined based on a number of factors, including but not limited to, how the coating liquid is being added to the coating container (e.g., continuously or not and the rate if continuously), the concentration of the modified particles in the coating liquid, the size of the particles, the density of the particles, the shape of the particles (the shape of the particles plays a role in how they arrange themselves in a monolayer), the size of the substrate, the number of substrates in the coating container, whether double or single sided coating is taking place, the size of the coating container, or a combination thereof. Factors other than these can also be considered to determine the rate at which the substrate can be separated from the coating container. An exemplary calculation of a lift off rate can be seen in the Examples that follow.

The rate at which the substrate can be separated from the subphase liquid, can but need not be constant throughout the separation. In an embodiment where continuous coating is taking place, the rate at which the substrate can be separated from the subphase liquid can be controlled by a feedback control loop. In an embodiment, the feedback control loop can be controlled by, amongst other things, the position of the front of the modified particle layer on the surface of the subphase liquid, the surface pressure on the subphase liquid, or a combination thereof.

Once a lift off rate has been calculated, modifications to the calculated lift off rate may be advantageous given practical considerations, such as the following. Some particles can sink into the subphase, this can be more likely to happen closer to the region where the coating liquid is dispensed into the coating container. Some particles can also leak through gaps between the substrate and the side walls of the coating container. To account for such losses, the actual lift-off rate can be about 40% to about 90% of a calculated theoretical rate. If the coating liquid dispensing rate is higher than that coating rate onto the substrate after accounting for all losses, the excess particles are deflected into the subphase by the existing film floating on the subphase.

Figure 3A:
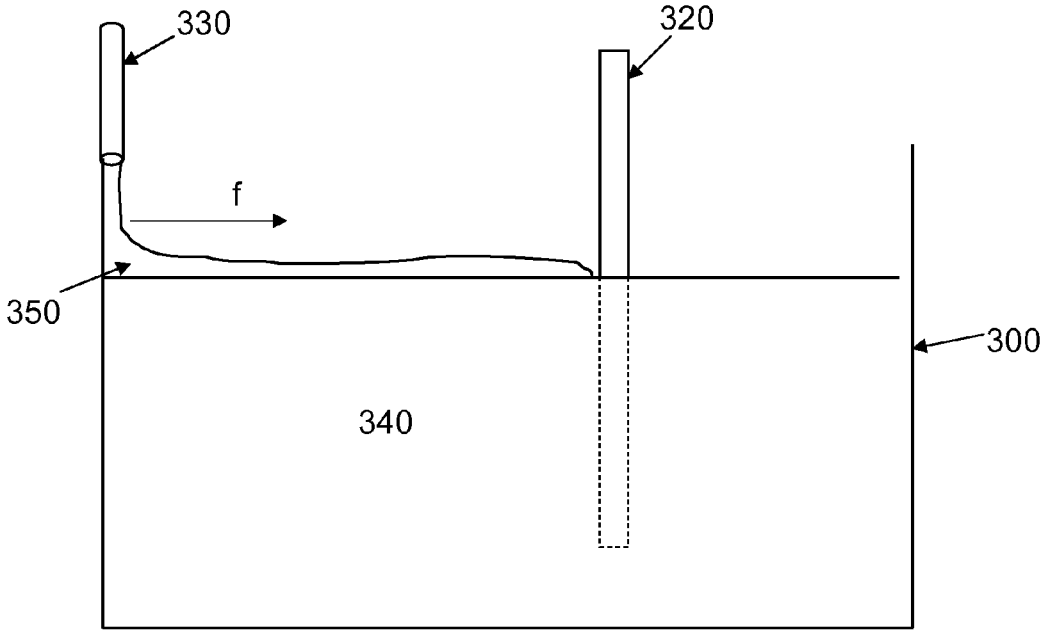
FIGS. 3*a* through 3*c* illustrate an exemplary embodiment of a coating method.
Figure 3B:
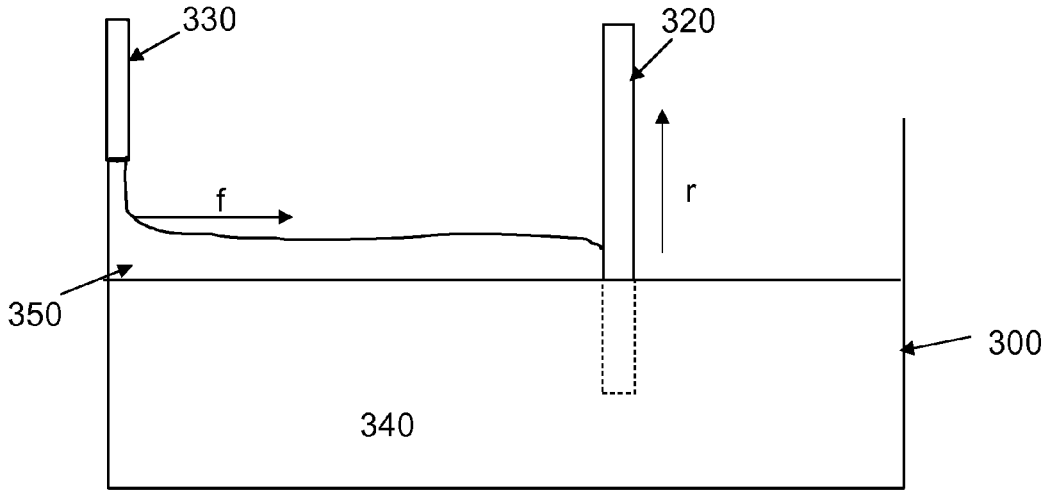
Figure 3C:
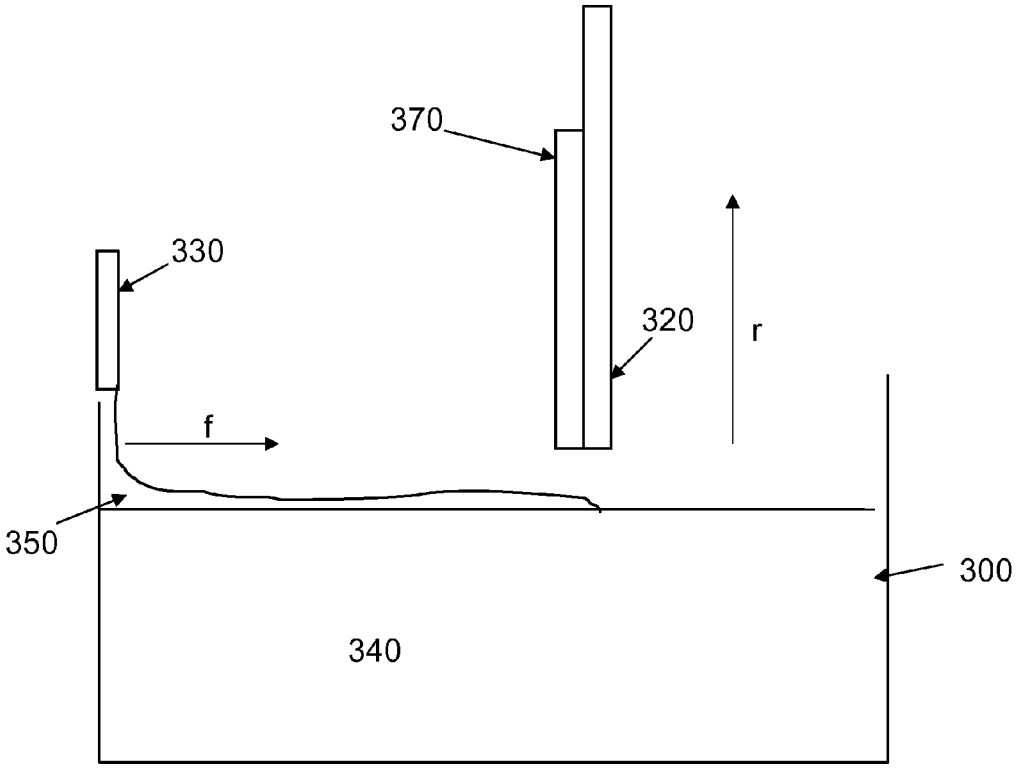

FIG. 3*a* through 3*c* illustrate various steps of an exemplary coating method. Once the coating liquid is formed (not shown in FIGS. 3*a* through 3*c*), a coating layer is formed on the subphase liquid. As seen in FIG. 3*a*, the coating liquid is dispensed into the coating container 300 via the coating liquid dispenser 330 to form the coating layer 350. The coating liquid flows away from its addition point at the dispenser 330 in a unitary direction designated by the arrow f in FIG. 3*a* forming the coating layer 350. The coating layer 350 is generally flowing in a unitary direction towards the substrate 320. Once the coating layer 350 is formed, the substrate 320 can be separated from the coating container 300, as indicated by the arrow r in FIG. 3*b*. In this particular embodiment, the substrate is being withdrawn from the subphase liquid. The substrate 320 is withdrawn further from the coating container 300 at a given rate of withdrawal until it is completely withdrawn from the coating container 300, as seen in FIG. 3*c*. Also as seen in FIG. 3*c*, withdrawal of the substrate 320 from the coating container 300 forms a coating 370 (not to scale) of modified particles on the substrate 320.

In an embodiment that coats the substrate while it is in a normal orientation, it can be advantageous for the substrate to have a width that is just slightly smaller than the inside width of the coating container. This can be advantageous in the normal orientation because this can minimize variability due to variable amounts of modified particles "leaking" around the edges of the substrate. "Leaking" can also result in the backside of the substrate being partially or variably coated, which can also be a disadvantage for some applications.

In another embodiment, a method as disclosed herein includes forming a coating liquid, wherein the coating liquid includes at least one modified particle and liquid carrier; forming a coating layer of the coating liquid on a surface of a subphase liquid, the subphase liquid is contained in a container, and a substrate is at least partially immersed within the subphase liquid; and separating the substrate and the container to transfer at least a portion of the coating layer to the substrate to form a particulate coating.

Methods as disclosed herein can also optionally include other steps not specifically discussed above, including, but not limited to the following. A substrate(s) can be affected in some way before it is placed in the coating container, for example, the substrate can be cleaned by known methods such as sonicating, washing and drying or a combination thereof; the substrate can be patterned to produce a patterned coating by known methods such as etching and photoresist techniques; or the substrate can be coated with a component using a method other than that disclosed herein. After being coated, the substrate can also be affected in some way, for example, the substrate can be dried using known drying methods; the substrate can be washed or rinsed using liquid carrier or other solvents; the substrate can be treated to effect removal of the modifier from the particles by heat treating the coated substrate in a controlled atmosphere; the substrate can also be subjected to oxygen plasma treatment to affect (low temperature) removal of the modifier from the particles; or the substrate can be further coated using methods disclosed herein or other methods.

Other optional steps that can be carried out in connection with methods disclosed herein include, but are not limited to recovery of modified particles from the subphase liquid. As mentioned above, some modified particles may enter the subphase liquid, these modified particles can be recovered and incorporated into a coating liquid in order to be coated at a later time. Methods commonly known to those of skill in the art for accomplishing particle recovery from a solution can be utilized. Recovery of the liquid carrier from the subphase liquid can also be carried out. As mentioned above, in some embodiments, a portion of the liquid carrier can dissolve into the subphase liquid after the coating liquid is dispensed into the coating container. Methods commonly known to those of skill in the art for accomplishing liquid-liquid separation can be utilized.

Methods as disclosed herein can also be carried out continuously. In a continuous method, the coating liquid is added to the coating container in a continuous manner so that the modified particles that are coated onto a substrate are replenished in the coating layer on the subphase liquid. The nature of the unitary flow of the coating liquid (from the addition point, the dispensing region to the removal point, the substrate) make methods disclosed herein very amenable to being carried out continuously.

In an embodiment where the method will be carried out continuously, the coating container could be modified to allow substrates to be introduced into the coating container in a continuous fashion. Alternatively, one or more additional devices could be configured to allow substrates to be introduced into the coating container allowing coating in a continuous fashion. The coating container or additional device(s) can be configured to at least partially immerse the additional substrate(s) into the subphase liquid at a region that is at least somewhat removed from the dispensing region, a region that is at least somewhat removed from a region where the substrate and the container are separated, or both. The substrate (s) could also be introduced into the subphase liquid at one region and moved in the subphase liquid to a region where the substrate and the coating container are separated. For example, the coating container could be modified to allow substrate(s) to be introduced into the coating container from other than the surface of the subphase liquid where the coating layer forms. More specifically, a rectangular coating container, for example, could be modified to allow substrates to be at least partially immersed into the coating liquid via the bottom of the coating container, an end of the coating container, a side of the coating container, or a combination thereof. An exemplary additional device that could be utilized to introduce substrate(s) into the coating container could include a device that is configured to at least partially immerse substrate(s) into the subphase liquid at a region at least somewhat removed from where they are ultimately separated from the container in order to coat. More specifically, the additional device could move the substrate(s) on an arcuate path from the region where they are introduced into the subphase liquid to the region where they are actually coated by separating them from the container.

Methods as disclosed herein can be utilized to coat one or more coatings on a substrate for any application for which coating technology is generally utilized. The coated substrate can be used as is, without further processing or can be acted upon further before use.

While the present disclosure is not so limited, an appreciation of various aspects of the disclosure will be gained through a discussion of the examples provided below.

EXAMPLES

Unless stated otherwise, all chemicals were obtained from Sigma-Aldrich (Milwaukee, Wis.) and were used as received.

Example 1

Calculation of Lift-Off Rate

The known parameters for this exemplary calculation are: pumping rate of the coating liquid ($V_{pump}$=0.5 mL/min); the concentration of silica particles in the coating liquid by mass ($C_{mass}$=8 mg/mL); the average diameter of the silica particles (dp=2.5 μm); the density of the silica particles ($\rho_{SiO2}$=2.196 g/cm$^3$); and the width of the substrate (W=25 mm).

The assumptions for this exemplary calculation are: the particles form a hexagonal close-packed monolayer; the area fraction in a hexagonal close-packed monolayer can be represented by Equation 1:

$$f_{jex} = \frac{\pi}{2 * \sqrt{3}} = 0.907; \text{ and} \quad \text{(Eqn. 1)}$$

the particle number density in a hexagonal close-packed monolayer can be represented by Equation 2:

$$\begin{aligned} A_{num} &= \frac{f_{hex}}{\frac{\pi}{4} * d_p^2} \\ &= \frac{0.907}{\frac{\pi}{4} * (2.5 * 10^{-4}\ \text{cm})^2} \\ &= 1.85 \times 10^7\ \text{particles/cm}^2; \end{aligned} \quad \text{(Eqn. 2)}$$

The calculation of lift-off rate can then be determined by the following. The silica particle concentration in the coating liquid by number of particles can be determined by Eqn. 3:

$$\begin{aligned} C_{num} &= \frac{C_{mass}}{\rho_{SiO2} * \frac{\pi}{6} * d_p^3} \\ &= \frac{8 \times 10^{-3}\ \text{g/mL}}{2.196\ \text{g/cm}^3 * \frac{\pi}{6} * (2.5 \times 10^{-4}\ \text{cm})^3} \\ &= 4.45 \times 10^8\ \text{particles/mL} \end{aligned} \quad \text{(Eqn. 3)}$$

For normal lift-off, it can be assumed that all particles are coated on the substrate and only the front side of the substrate is coated; then the theoretical lift-off rate can be determined by Eqn. 4:

$$\begin{aligned} v_{theoretical} &= \frac{C_{num} * V_{pump}}{A_{num} * W} \\ &= \frac{4.45 \times 10^8\ \text{particles/mL} * 0.5\ \text{mL/min}}{1.85 \times 10^7\ \text{particles/cm}^2 * 2.5\ \text{cm}} \\ &= 4.81\ \text{cm/min} \\ &= 0.803\ \text{mm/sec} \end{aligned} \quad \text{(Eqn. 4)}$$

Where double sided coating is to be accomplished (i.e. tangential coating or back to back placement of substrates), the lift-off rate calculated above can be cut in half.

Example 2

Substrate Coating 200 mg of a dry powder of silica microspheres (mean diameter from 2.5 μm; Bangs Laboratories, Fishers, Ind.) was sonicated and dispersed in 20 mL 200 proof ethanol. 0.2 mL of 29% ammonium hydroxide ($NH_4OH$), 69 μL octadecyltrimethoxysilane (OTMS) and 2 mL chloroform were added to the dispersion. The solution was then stirred, at room temperature for 12 to 24 hours to allow the OTMS to chemically graft to the hydroxyl groups of the silica particles. The grafted silica particles were then separated from the liquid by centrifugation at 5,000 RPM for about 30 minutes and washing with ethanol. The grafted particles were dispersed in IPA to a concentration of 8 mg/mL.

A rectangular trough (3 inches long×1 inch wide×6 inches high) was filled with deionized water. An EAGLE2000™ glass substrate (3 inches long×25 mm wide×0.7 mm thick, Corning Inc., Corning N.Y.), which was cleaned by sonicating in acetone for 10 minutes, rinsing in ethanol and blowing dry with a stream of $N_2$ gas was partially submersed in the water tangential to the general expected flow direction of the coating liquid (in the center of the rectangular trough with the surfaces (instead of the sides) of the substrate parallel with the long side of the trough).

The dispersion, prepared above, was continuously pumped into the trough using a syringe pump at a rate of 0.5 mL/min and allowed to flow down the wall at one of the short ends of the trough. The dispersion spread on the surface of the water. Once enough particles were pumped into the container, a dense monolayer was formed at the surface of the water. The substrate was then lifted upwards in the trough at a speed of 0.31 mm/sec. Once the entire substrate was lifted from the water subphase, it was allowed to dry under ambient conditions.

Another coating experiment was carried out using the same conditions as above with the exception that the substrate was submersed in the water normal to the general expected flow direction of the coating liquid (in the center of the rectangular trough with the surfaces (instead of the sides) of the substrate perpendicular to the long side of the trough); and the rate at which the substrate was lifted upwards was 0.63 mm/sec.

Figure 4A:
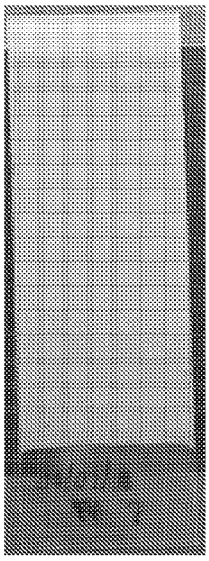
FIGS. 4*a* and 4*b* are a digital image (FIG. 4*a*) and an optical micrograph (FIG. 4*b*) of a coating formed in Example 1.
Figure 4B:
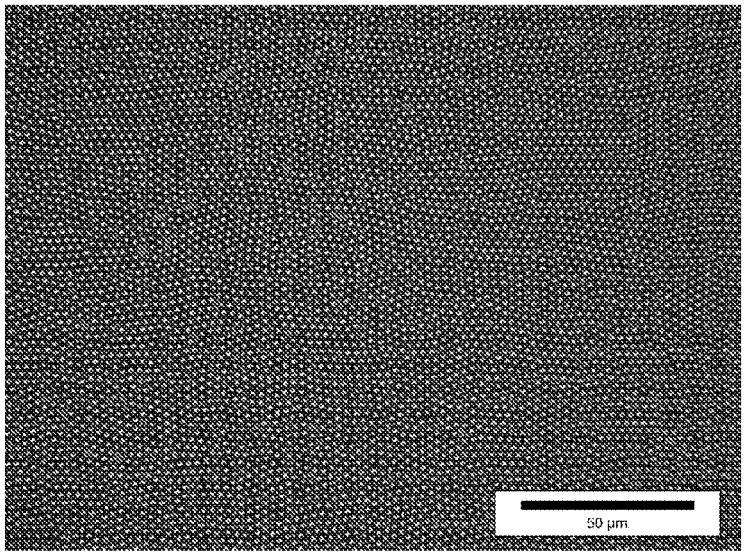
Figures 5A, 5B:
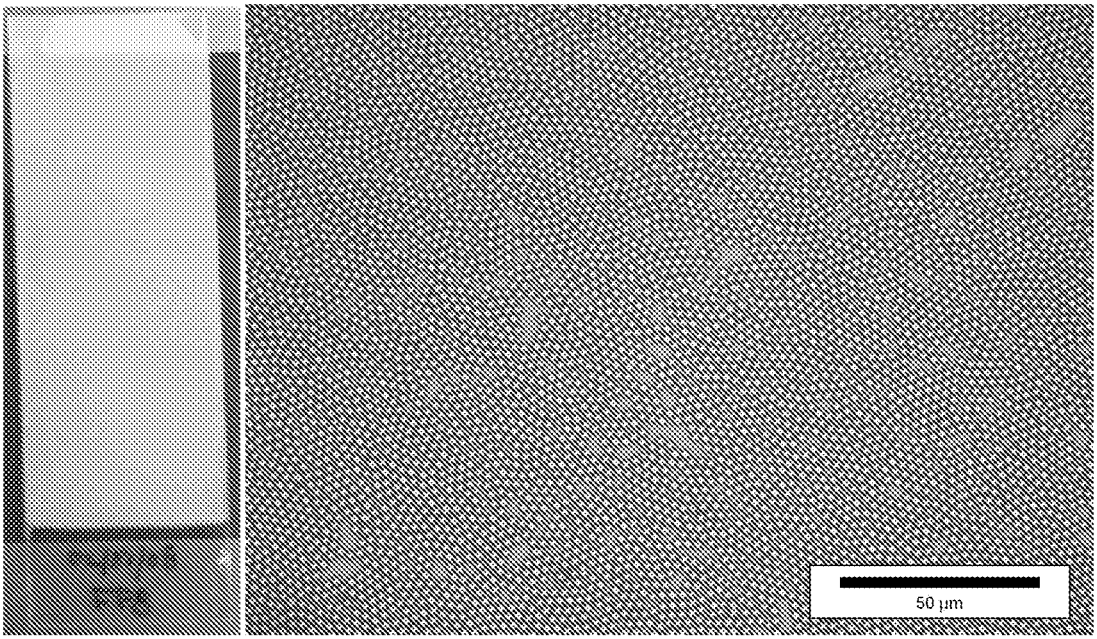
FIGS. 5*a* and 5*b* are a digital image (FIG. 5*a*) and an optical micrograph (FIG. 5*b*) of a coating formed in Example 1.

A digital camera and an optical microscope were used to record images of the two coated substrates. FIG. 4 shows the images from the digital camera (FIG. 4*a*) and the optical microscope (FIG. 4*b*) for the substrate that was submersed in the trough in the normal direction; and FIG. 5 shows the images from the digital camera (FIG. 5*a*) and the optical microscope (FIG. 5*b*) for the substrate that was submersed in the trough in the tangential direction.

Thus, embodiments of methods of forming particulate coatings are disclosed. The implementations described above and other implementations are within the scope of the following claims. One skilled in the art will appreciate that the present disclosure can be practiced with embodiments other than those disclosed. The disclosed embodiments are presented for purposes of illustration and not limitation.

What is claimed is:

1. A particulate coating method comprising:

forming a coating liquid comprising at least one modified particle, and a liquid carrier, the modified particle formed by covalently attaching a modifier to a particle;

dispensing the coating liquid onto a surface of a subphase liquid, the subphase liquid is in a container, the container having at least one pair of substrates, wherein each of the at least one pair of substrates consists of two substrates placed back to back with the sides not to be coated facing each other to the inside, the at least one pair of substrates, is at least partially immersed in the subphase liquid, to form a coating layer on the surface of the subphase liquid, wherein substantially all the coating layer has a substantially unitary direction of flow on the surface of the subphase liquid from the surface where the coating liquid was dispensed to the substrate, wherein the substantially unitary direction of flow of the coating liquid is promoted by the concentration of the coating liquid dispensed into the container, and wherein the surface to be coated is oriented in the container parallel to the direction of the coating layer flow; and separating the at least one pair of substrates from the container to transfer at least a portion of the coating layer to the at least one pair of substrates to form a particulate coating on at least a portion of the at least one pair of substrates.

2. The method of claim 1, wherein the at least one modifier is hydrophobic.

3. The method of claim 2, wherein the subphase liquid is polar.

4. The method of claim 3, wherein the at least one particle is hydrophilic.

5. The method of claim 4, wherein the at least one particle is an inorganic oxide particle.

6. The method of claim 5, wherein the modifier is a silane having one or more substituents having a $C_8$ to $C_{24}$ alkyl group.

7. The method of claim 1, wherein the modified particle has a diameter from about 2 nm to about 20 micrometers.

8. The method of claim 1, wherein the liquid carrier comprises at least one of an alcohol, an ether, or a mixture thereof.

9. The method of claim 1, wherein the modified particle has a concentration of about 0.05 to about 20 mg/mL in the coating liquid.

10. The method of claim 1, wherein separating the at least one pair of substrates from the container comprises withdrawing the at least one pair of substrates from the container, withdrawing the container from the at least one pair of substrates, or a combination thereof.

11. The method of claim 1 further comprising continuously forming a particulate coating layer on the subphase liquid in the container while at least partially immersing into and then separating the at least one pair of substrates from the container.

12. The method of claim 11, wherein the at least one pair of substrates is at least partially immersed into the subphase liquid at a region removed from a region where the at least one pair of substrates and the coating container are separated to form the particulate coating.

13. A particulate coating method comprising:

forming a coating liquid comprising at least one modified particle and a liquid carrier, the modified particle having been formed by covalently attaching a hydrophobic modifier to a particle;

streaming the coating liquid into a container, the container having a subphase liquid and at least one pair of substrates, wherein each of the at least one pair of substrates consists of two substrates placed back to back with the sides not to be coated facing each other to the inside, the at least one pair of substrates is at least partially immersed therein to form a coating layer on the surface of the subphase liquid, substantially all of the coating layer having a substantially unitary direction of flow on the surface of the subphase liquid from the area of layer formation to the substrate, wherein the substantially unitary direction of flow of the coating liquid is promoted by the concentration of the coating liquid streamed into the container, wherein the surface to be coated is oriented in the container parallel to the direction of the coating layer flow; and separating the at least one pair of substrates from the container to form a particulate coating on the at least one pair of substrates.

* * * * *